US007261649B2

(12) United States Patent
Ohama et al.

(10) Patent No.: US 7,261,649 B2
(45) **Date of Patent: *Aug. 28, 2007**

(54) GOLF BALL

(75) Inventors: Keiji Ohama, Kobe (JP); Takahiro Sajima, Kobe (JP)

(73) Assignee: SRI Sports Limited, Kobe-Shi, Hyogo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 11/294,404

(22) Filed: Dec. 6, 2005

(65) Prior Publication Data

US 2006/0154748 A1 Jul. 13, 2006

(30) Foreign Application Priority Data

Jan. 7, 2005 (JP) ..... 2005-002069

(51) Int. Cl.
*A63B 37/14* (2006.01)

(52) U.S. Cl. ..... 473/383

(58) Field of Classification Search ..... 473/378–385
See application file for complete search history.

(56) References Cited

U.S. PATENT DOCUMENTS 5,338,039 A 8/1994 Oka et al.
5,735,757 A 4/1998 Moriyama
6,299,551 B1 10/2001 Higuchi et al.
6,336,872 B1 * 1/2002 Moriyama et al. ..... 473/374
6,599,204 B2 * 7/2003 Kasashima et al. ..... 473/383
6,659,888 B2 12/2003 Endo et al.
6,899,643 B2 * 5/2005 Sajima et al. ..... 473/383
6,951,520 B2 * 10/2005 Ohama et al. ..... 473/383
2003/0040378 A1 2/2003 Endo et al.
2005/0272532 A1 * 12/2005 Sajima ..... 473/378
2006/0116220 A1 * 6/2006 Ohama et al. ..... 473/371
2006/0116222 A1 * 6/2006 Sajima et al. ..... 473/383
2006/0154749 A1 * 7/2006 Ohama et al. ..... 473/378

* cited by examiner

*Primary Examiner*—Raeann Trimiew
(74) *Attorney, Agent, or Firm*—Birch, Stewart, Kolasch & Birch, LLP

(57) ABSTRACT

Golf ball 2 has a center 8, a mid layer 10, a cover 6 and dimples 12. The mid layer 10 includes a styrene block-containing thermoplastic elastomer having a material hardness of less than 10, and an ethylene-(meth)acrylic acid copolymer-based ionomer resin having a material hardness of 50 or greater and 70 or less. This mid layer 10 has a hardness equal to or less than 50, and a thickness of equal to or less than 1.6 mm. The dimple has: a first side wall face 18 that has a curvature radius R1 which is equal to or greater than a phantom curvature radius Rx; a second side wall face 20 that is positioned to the bottom side than the first side wall 18 face and has a curvature radius R2 which is smaller than the phantom curvature radius Rx; and a bottom face 22 that is positioned to the bottom side than the second side wall face 20 and has a curvature radius R3 which is equal to or greater than the phantom curvature radius Rx.

6 Claims, 6 Drawing Sheets

GOLF BALL

This application claims priority on Patent Application No. 2005-2069 filed in JAPAN on Jan. 7, 2005. The entire contents of this Japanese Patent Application are hereby incorporated by reference.

BACKGROUND OF THE INVENTION

1. Field of the Invention

The present invention relates to golf balls. More particularly, the present invention relates to solid golf balls having a core and a cover.

2. Description of the Related Art

In recent years, three-piece golf balls were developed in attempts to accomplish a feel at impact that is comparative to wound balls, and have been supplied on the market. JP-A No. 2000-70408 (U.S. Pat. No. 6,299,511) and JP-A No. 2003-52855 (US 2003-40378A1) disclose three-piece golf balls having a mid layer that includes a thermoplastic elastomer.

Golf balls have numerous dimples on the surface thereof. In general, golf balls have single radius dimples having a cross-sectional shape with single curvature radius, or double radius dimples having a cross-sectional shape with two curvature radii. The dimples disrupt the air flow around the golf ball during flight to cause turbulent flow separation. By causing the turbulent flow separation, separating points of the air from the golf ball shift backwards leading to the reduction of a drag. The turbulent flow separation promotes the displacement of the separating point on the upper side and the separating point on the lower side of the golf ball, which results from the backspin, thereby enhancing the lift force that acts upon the golf ball. Reduction of drag and improvement of lift force is referred to as a "dimple effect". Excellent dimples disturb the air flow more efficiently.

A variety of proposals with respect to the cross-sectional shape of the dimples in attempts to improve flight performances have been made. JP-A No. H05-96026 (U.S. Pat. No. 5,338,039) discloses dimples having a shape with the gradient of a slope disposed in the vicinity of the edge being greater than that of a slope at the bottom part. JP-A No. H09-70449 (U.S. Pat. No. 5,735,757) discloses dimples having a cross-sectional shape given by double radius. JP-A No. 2004-166725 (U.S. Pat. No. 6,899,643) discloses dimples having a great ratio of the curvature radius of the bottom part to the curvature radius in the vicinity of the edge.

With respect to matching of the dimples and the structure, a variety of proposals have been made. JP-A No. 2003-199846 (U.S. Pat. No. 6,659,888) discloses a golf ball having a soft mid layer, and having dimples improved with respect to the contour length.

Top concern to golf players for golf balls is the flight distance. In general, golf balls that are excellent in resilience performances are excellent in the flight performance. However, insufficient feel at impact may be experienced according to golf balls on which only the resilience performance was considered. An object of the present invention is to provide a golf ball that is excellent in the flight performance and feel at impact.

SUMMARY OF THE INVENTION

Golf ball according to the present invention has a spherical core, a cover covering this core and numerous dimples formed on the surface thereof. This cover has a shore D hardness of equal to or greater than 50, and a thickness of equal to or less than 1.6 mm. The dimple has:

(1) a first side wall face that has a curvature radius R1 which is equal to or greater than a phantom curvature radius Rx;

(2) a second side wall face that is positioned to the bottom side than this first side wall face and has a curvature radius R2 which is smaller than the phantom curvature radius Rx; and (3) a bottom face that is positioned to the bottom side than this second side wall face and has a curvature radius R3 which is equal to or greater than the phantom curvature radius Rx. The phantom curvature radius Rx according to the present invention means the curvature radius of a phantom dimple. This phantom dimple means a single radius dimple having a diameter that is equal to the diameter of the dimple, and having a volume that is equal to the volume of the dimple.

According to this golf ball, direction of the air flow from a land toward the center of the dimple varies three times stepwise. This dimple disturbs air flow more efficiently. In this golf ball, the cover is responsible for the resilience performance. Owing to synergistic effect of the aerodynamic characteristic and the resilience performance, a great flight distance is attained by this golf ball. Because this golf ball has a thin cover, this golf ball is also excellent in the feel at impact.

Preferably, ratio of depth of the first side wall face to depth of the dimple is 0.10 or greater and 0.50 or less. Preferably, ratio of maximum diameter of the second side wall face to diameter of the dimple is 0.60 or greater and 0.95 or less.

Preferably, the core has a spherical center and a mid layer covering this center. This mid layer has a Shore D hardness of 25 or greater and 55 or less, and a thickness of equal to or less than 1.6 mm. Surface hardness of this center is equal to or greater than Shore D hardness of the mid layer. Preferably, ratio of the thickness of the cover to the thickness of the mid layer is 1.0 or greater and 2.0 or less.

Preferably, the mid layer comprises 20% by weight or greater and 60% by weight or less of a styrene block-containing thermoplastic elastomer having a material hardness of less than 10, and 40% by weight or greater and 80% by weight or less of an ethylene-(meth)acrylic acid copolymer-based ionomer resin having a material hardness of 50 or greater and 70 or less.

DESCRIPTION OF THE PREFERRED EMBODIMENTS

The present invention is hereinafter described in detail with appropriate references to the accompanying drawing according to the preferred embodiments.

Figure 1:
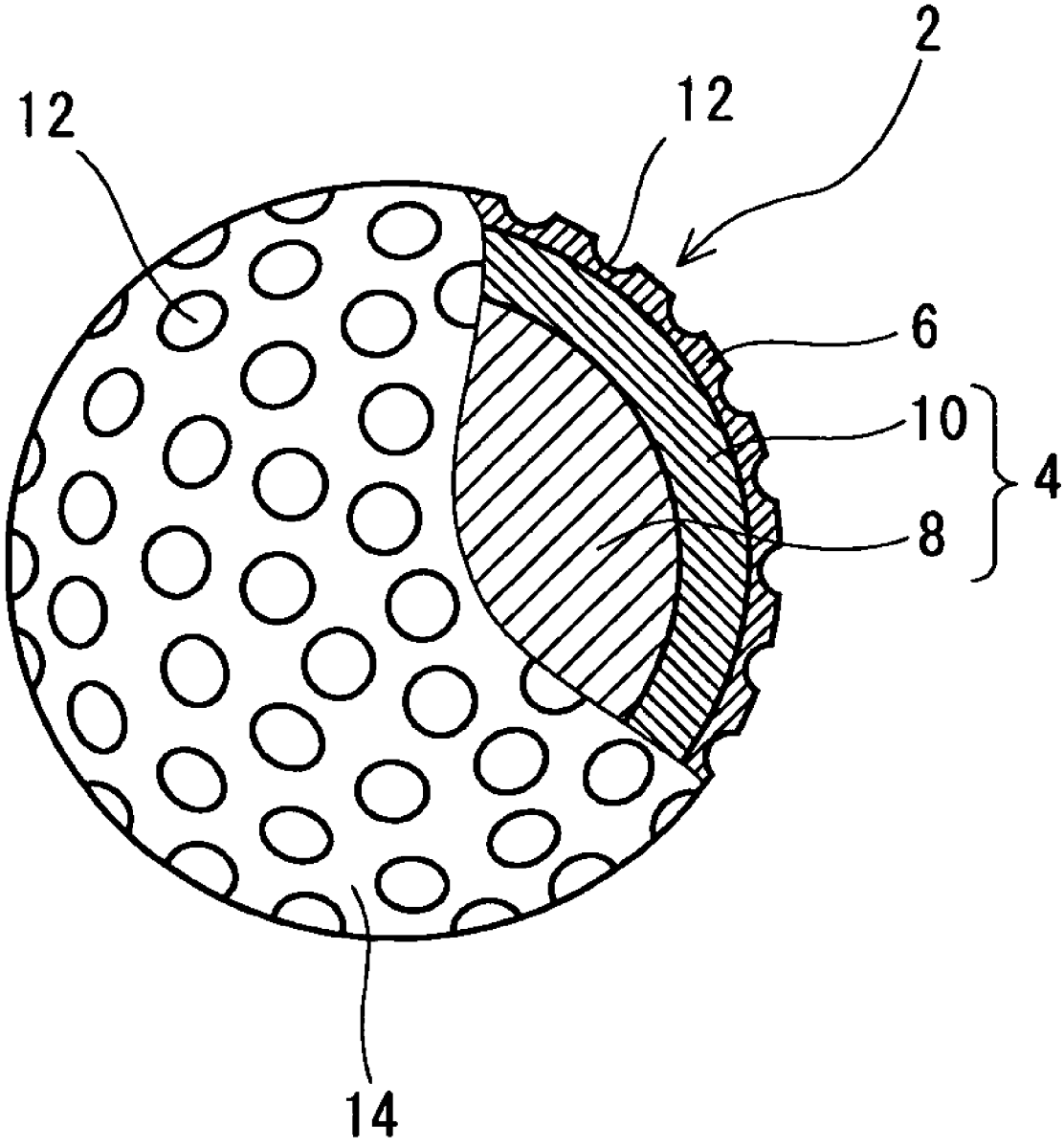
FIG. 1 is a schematic cross-sectional view illustrating a golf ball according to one embodiment of the present invention.

A golf ball 2 illustrated in FIG. 1 has a spherical core 4, and a cover 6 covering this core 4. The core 4 includes a spherical center 8 and a mid layer 10 covering this center 8. Numerous dimples 12 are formed on the surface of the cover 6. Of the surface of the golf ball 2, a part except for the dimples 12 is a land 14. This golf ball 2 has a paint layer and a mark layer to the external side of the cover 6, although these layers are not shown in the Figure. The core 4 may be constituted from single layer. The golf ball 2 may have other layer between the center 8 and the mid layer 10. The golf ball 2 may have other layer between the mid layer 10 and the cover 6.

The cover 6 herein means an outermost layer except for the paint layer and mark layer. Although there exist golf balls referred to as having a cover with a two layered structure, in this instance, the outer layer corresponds to the cover 6 herein.

This golf ball 2 has a diameter of from 40 mm to 45 mm. From the standpoint of conformity to a rule defined by United States Golf Association (USGA), the diameter is preferably equal to or greater than 42.67 mm. In light of suppression of the air resistance, the diameter is preferably equal to or less than 44 mm, and more preferably equal to or less than 42.80 mm. Weight of this golf ball 2 is 40 g or greater and 50 g or less. In light of attainment of great inertia, the weight is preferably equal to or greater than 44 g, and particularly preferably equal to or greater than 45.00 g. From the standpoint of conformity to a rule defined by USGA, the weight is preferably equal to or less than 45.93 g.

The center 8 is usually obtained through crosslinking of a rubber composition. Illustrative examples of the base rubber for use in the rubber composition include polybutadienes, polyisoprenes, styrene-butadiene copolymers, ethylene-propylene-diene copolymers and natural rubbers. Two or more kinds of the rubbers may be used in combination. In light of the resilience performance, polybutadienes are preferred. When other rubber is used in combination with a polybutadiene, it is preferred that polybutadiene is included as a principal component. Specifically, it is preferred that percentage of polybutadiene in the entire base rubber is equal to or greater than 50% by weight, and particularly equal to or greater than 80% by weight. High cis-polybutadienes having a percentage of cis-1,4 bonds of equal to or greater than 80% are particularly preferred.

For crosslinking of the center 8, a co-crosslinking agent is usually used. Preferable examples of the co-crosslinking agent in light of the resilience performance include monovalent or bivalent metal salts of an α,β-unsaturated carboxylic acid having 2 to 8 carbon atoms. Specific examples of preferable co-crosslinking agent include zinc acrylate, magnesium acrylate, zinc methacrylate and magnesium methacrylate. Zinc acrylate and zinc methacrylate are particularly preferred on the grounds that a high resilience performance can be achieved.

As a co-crosslinking agent, an α,β-unsaturated carboxylic acid having 2 to 8 carbon atoms, and a metal oxide may be also blended. Both components react in the rubber composition to give a salt. This salt serves as a co-crosslinking agent. Examples of preferable α,β-unsaturated carboxylic acid include acrylic acid and methacrylic acid. Examples of preferable metal oxide include zinc oxide and magnesium oxide, and zinc oxide is particularly preferred.

In light of the resilience performance of the golf ball 2, the amount of the co-crosslinking agent to be blended is preferably equal to or greater than 10 parts by weight, and more preferably equal to or greater than 15 parts by weight per 100 parts by weight of the base rubber. In light of soft feel at impact, the amount of the co-crosslinking agent to be blended is preferably equal to or less than 50 parts by weight, and more preferably equal to or less than 45 parts by weight per 100 parts by weight of the base rubber.

Into the rubber composition for use in the center 8, an organic peroxide may be preferably blended together with the co-crosslinking agent. The organic peroxide is responsible for a crosslinking reaction. By blending the organic peroxide, the resilience performance of the golf ball 2 may be improved. Examples of suitable organic peroxide include dicumyl peroxide, 1,1-bis(t-butylperoxy)-3,3,5-trimethylcyclohexane, 2,5-dimethyl-2,5-di(t-butylperoxy)hexane and di-t-butyl peroxide. Particularly versatile organic peroxide is dicumyl peroxide.

In light of the resilience performance of the golf ball 2, the amount of the organic peroxide to be blended is preferably equal to or greater than 0.1 part by weight, more preferably equal to or greater than 0.3 part by weight, and particularly preferably equal to or greater than 0.5 part by weight per 100 parts by weight of the base rubber. In light of soft feel at impact, the amount of the organic peroxide to be blended is preferably equal to or less than 3.0 parts by weight, more preferably equal to or less than 2.8 parts by weight, and particularly preferably equal to or less than 2.5 parts by weight per 100 parts by weight of the base rubber.

It is preferred that an organic sulfur compound (including a salt) be blended in the center 8. The organic sulfur compound is responsible for resilience performance of the golf ball 2. Illustrative examples of preferable organic sulfur compound include diphenyl disulfide and bis(pentabromophenyl)disulfide.

In light of the resilience performance of the golf ball 2, the amount of the organic sulfur compound to be blended is preferably equal to or greater than 0.1 part by weight, more preferably equal to or greater than 0.2 part by weight, and particularly preferably equal to or greater than 0.3 part by weight per 100 parts by weight of the base rubber. In light of soft feel at impact, the amount of the organic sulfur compound to be blended is preferably equal to or less than 5.0 parts by weight, more preferably equal to or less than 3.0 parts by weight, and particularly preferably equal to or less than 2.0 parts by weight per 100 parts by weight of the base rubber.

Into the center 8 may be blended a filler for the purpose of adjusting specific gravity and the like. Illustrative examples of suitable filler include zinc oxide, barium sulfate, calcium carbonate and magnesium carbonate. Powder of a highly dense metal may be blended as a filler. Specific examples of the highly dense metal include tungsten and molybdenum. The amount of the filler to be blended is determined ad libitum so that the intended specific gravity of the center 8 can be accomplished. Particularly preferable filler is zinc oxide. Zinc oxide also serves as a crosslinking activator. Various kinds of additives such as a sulfur compound, an anti-aging agent, a coloring agent, a plasticizer, a dispersant and the like may be blended at an adequate amount to the center 8 as needed. Into the center 8 may be also blended crosslinked rubber powder or synthetic resin powder.

In light of the feel at impact of the golf ball 2, amount of compressive deformation of the center 8 is preferably equal to or greater than 3.0 mm, more preferably equal to or greater than 3.2 mm, and particularly preferably equal to or greater than 3.5 mm. In light of the resilience performance and durability performance of the golf ball 2, amount of compressive deformation of the center 8 is preferably equal to or less than 6.0 mm, and more preferably equal to or less than 5.5 mm. Upon measurement of the amount of compressive deformation, the center 8 is first placed on a hard plate made of metal. Next, a cylinder made of metal gradually descends toward the center 8. The center 8 intervened between the bottom face of the cylinder and the hard plate is deformed. A migration distance of the cylinder, starting from the state in which initial load of 98 N is applied to the center 8 up to the state in which final load of 1274 N is applied thereto is the amount of compressive deformation.

In light of the resilience performance of the golf ball 2, the center 8 has a surface hardness Hs of preferably equal to or greater than 40, and more preferably equal to or greater than 45. In light of the feel at impact and suppression of spin of the golf ball 2, the center 8 has a surface hardness Hs of preferably equal to or less than 65, more preferably equal to or greater than 60, and particularly preferably equal to or less than 55. For the measurement of the surface hardness Hs, an automated rubber hardness machine which is equipped with a Shore D type spring hardness scale (trade name "P1", available from Koubunshi Keiki Co., Ltd.) is used. This hardness scale is pressed against the surface of the center 8.

The center 8 has a diameter of preferably 35 mm or greater and 42 mm or less. Crosslinking temperature of the center 8 is usually 140° C. or greater and 180° C. or less. The crosslinking time period of the center 8 is usually 10 minutes or longer and 60 minutes or less. Specific gravity of the center 8 is 0.90 or greater and 1.40 or less.

In the mid layer 10, a styrene block-containing thermoplastic elastomer and an ethylene-(meth)acrylic acid copolymer-based ionomer resin are used as a base polymer through blending.

Examples of the styrene block-containing thermoplastic elastomer include styrene-butadiene-styrene block copolymers (SBS), styrene-isoprene-styrene block copolymers (SIS), styrene-isoprene-butadiene-styrene block copolymers (SIBS), hydrogenated SBS, hydrogenated SIS and hydrogenated SIBS. Exemplary hydrogenated SBS include styrene-ethylene-butylene-styrene block copolymers (SEBS). Exemplary hydrogenated SIS include styrene-ethylene-propylene-styrene block copolymers (SEPS). Exemplary hydrogenated SIBS include styrene-ethylene-ethylene-propylene-styrene block copolymers (SEEPS).

In the present invention, exemplary styrene block-containing thermoplastic elastomer may include alloys of olefin and one or two or more selected from the group consisting of SBS, SIS, SIBS, SEBS, SEPS and SEEPS, and hydrogenated products thereof. Olefin component in these alloys is presumed to be responsible for the improvement of compatibility between the thermoplastic elastomer and the ionomer resin. Use of this alloy may improve the resilience performance of the golf ball 2. Preferably, an olefin having 2 to 10 carbon atoms may be used.

In light of the resilience performance of the golf ball 2, content of the styrene component in the thermoplastic elastomer is preferably equal to or greater than 10% by weight, more preferably equal to or greater than 12% by weight, and particularly preferably equal to or greater than 15% by weight. In light of the feel at impact of the golf ball 2, the content is preferably equal to or less than 50% by weight, more preferably equal to or less than 47% by weight, and particularly preferably equal to or less than 45% by weight.

Preferably, a styrene block-containing thermoplastic elastomer having a material hardness of less than 10 may be used in the mid layer 10. The styrene block-containing thermoplastic elastomer having a small material hardness is responsible for improvement of the feel at impact even in a small amount. By using the styrene block-containing thermoplastic elastomer having a small material hardness, the amount thereof can be set to be small. In other words, by using the styrene block-containing thermoplastic elastomer having a small material hardness, other polymer that is excellent in the resilience performance can be blended in a large amount. In light of the resilience performance of the golf ball 2, the material hardness of the styrene block-containing thermoplastic elastomer is more preferably less than 8, and particularly preferably less than 6. The material hardness is usually equal to or greater than 2. The term "hardness" herein means, unless otherwise noted, the hardness measured in accordance with a standard of "ASTM-D 2240-68". The measurement is carried out with an automated rubber hardness machine which is equipped with a Shore D type spring hardness scale (trade name "P1", available from Koubunshi Keiki Co., Ltd.). For the measurement, a sheet which is formed by hot press is used having a thickness of about 2 mm and consisting of the polymer or the polymer composition. Prior to the measurement, the sheet is stored at a temperature of 23° C. for two weeks. Upon the measurement, three sheets are overlaid. According to the present invention, the material hardness means a hardness of a slab consisting of the polymer alone. For a reference, the material hardness of the styrene block-containing thermoplastic elastomer measured in accordance with "JIS K6301" with a type A hardness scale is preferably less than 80, more preferably less than 60, and particularly preferably less than 40.

Specific examples of the styrene block-containing thermoplastic elastomer having a material hardness of less than 10 include "Rabalon® T3339C", a trade name by Mitsubishi Chemical Corporation.

The ethylene-(meth)acrylic acid copolymer-based ionomer resin is obtained by the copolymerization of ethylene and acrylic acid or methacrylic acid. This ionomer resin generally contains 70% by weight or greater and 95% by weight or less of an ethylene component, and 5% by weight or greater and 30% by weight or less of an acrylate component or a methacrylate component. A part of carboxylic acid in the copolymer is neutralized by a metal ion. Illustrative examples of the metal ion for use in neutralization include sodium ion, potassium ion, lithium ion, zinc ion, calcium ion, magnesium ion, aluminum ion and neodymium ion. The neutralization may be carried out with two or more kinds of metal ions. Particularly suitable metal ion in light of the resilience performance and durability performance of the golf ball 2 is sodium ion, zinc ion, lithium ion and magnesium ion.

In this mid layer 10, an ethylene-(meth)acrylic acid copolymer-based ionomer resin having a material hardness of 50 or greater and 70 or less may be preferably used. In light of the resilience performance of the golf ball 2, the material hardness of this ionomer resin is more preferably equal to or greater than 53, and particularly preferably equal to or greater than 55. In light of the feel at impact and suppression of spin of the golf ball 2, the material hardness of this ionomer resin is more preferably equal to or less than 67, and particularly preferably equal to or less than 65.

Specific examples of the ethylene-(meth)acrylic acid copolymer-based ionomer resin having a material hardness of 50 or greater and 70 or less include "Himilan 1555", "Himilan 1557", "Himilan 1605" and "Himilan 1706", trade names by Du Pont-MITSUI POLYCHEMICALS Co., Ltd.; and "Surlyn® 8945" and "Surlyn® 9945", trade names by Dupont.

Proportion "Pst" of the styrene block-containing thermoplastic elastomer having a material hardness of less than 10 in the mid layer 10 is preferably 20% by weight or greater and 60% by weight or less. Proportion "Pio" of the ethylene-(meth)acrylic acid copolymer-based ionomer resin having a material hardness of 50 or greater and 70 or less in the mid layer 10 is preferably 40% by weight or greater and 80% by weight or less. Excellent compatibility is achieved between the styrene block-containing thermoplastic elastomer having a material hardness of less than 10 and the ethylene-(meth) acrylic acid copolymer-based ionomer resin having a material hardness of 50 or greater and 70 or less. Both components are admixed at the molecular level. This mid layer 10 is excellent in strength and rebound resilience despite of the low hardness. In light of the feel at impact of the golf ball 2, the proportion "Pst" of the styrene block-containing thermoplastic elastomer is more preferably equal to or greater than 25% by weight, and particularly preferably equal to or greater than 30% by weight. In light of the resilience performance of the golf ball 2, the proportion "Pio" of the ethylene-(meth)acrylic acid copolymer-based ionomer resin is more preferably equal to or greater than 45% by weight, and particularly preferably equal to or greater than 50% by weight.

As the base polymer of the mid layer 10, (A) a styrene block-containing thermoplastic elastomer having a material hardness of less than 10, and (B) an ethylene-(meth)acrylic acid copolymer-based ionomer resin having a material hardness of 50 or greater and 70 or less, as well as (C) other polymer may be used in combination. The other polymer (C) alone may be used in the mid layer 10. Examples of the other polymer (C) include (C1) styrene block-containing thermoplastic elastomers other than that described in (A) above, (C2) ionomer resins other than that described in (B) above, (C3) thermoplastic polyurethane elastomers, (C4) thermoplastic polyamide elastomers, (C5) thermoplastic polyester elastomers and (C6) thermoplastic polyolefin elastomers.

Specific examples of the styrene block-containing thermoplastic elastomer (C1) other than that described in (A) above include "Epofriend® A1010", a trade name by Daicel Chemical Industries; "Septon HG-252", a trade name by Kuraray Co., Ltd.; and "Rabalon® SJ5400N", "Rabalon® SJ6400N", "Rabalon® SJ7400N", "Rabalon® SJ8400N", "Rabalon® SJ9400N" and "Rabalon® SR04", trade names by Mitsubishi Chemical Corporation.

Specific examples of the ionomer resin (C2) other than that described in (B) above include "Himilan AM7316", a trade name by Du Pont-MITSUI POLYCHEMICAL Co., Ltd.; "Surlyn® 6320", "Surlyn® 8120", "Surlyn® 8320" and "Surlyn® 9320", trade names by Dupont; and "IOTEK 7520", a trade name by Exxon Corporation.

Examples of the thermoplastic polyurethane elastomer (C3) include "Kuramiron 9180" and "Kuramiron 9195", trade names by Kuraray Co., Ltd., and "Elastollan ET880" and "Elastollan ET890", trade names by BASF Polyurethane Elastomers Co., Ltd.

Examples of the thermoplastic polyamide elastomer (C4) include "Pebax 2533", a trade name by Toray Industries, Inc.

Examples of the thermoplastic polyester elastomer (C5) include "Hytrel® 4047", "Hytrel® 4767" and "Hytrel® 5557", trade names by Du Pont-TORAY Co., LTD., and "Primalloy® A1500", a trade name by Mitsubishi Chemical Corporation.

Examples of the thermoplastic polyolefin elastomer (C6) include "Milastomer® M4800NW", a trade name by Mitsui Chemicals, Inc., and "TPE 3682" and "TPE 9455", trade names by Sumitomo Chemical Co., Ltd.

When the styrene block-containing thermoplastic elastomer (A) having a material hardness of less than 10, the ethylene-(meth)acrylic acid copolymer-based ionomer resin (B) having a material hardness of 50 or greater and 70 or less and the other polymer (C) are used in the mid layer 10, total amount of the styrene block-containing thermoplastic elastomer (A) having a material hardness of less than 10 and the ethylene-(meth)acrylic acid copolymer-based ionomer resin (B) having a material hardness of 50 or greater and 70 or less is preferably equal to or greater than 90 parts by weight per 100 parts by weight of the entire base polymer.

Into the mid layer 10 may be blended a filler, a dispersant, a coloring agent and the like in an adequate amount as needed. The mid layer 10 may be blended with powder of a highly dense metal such as tungsten, molybdenum or the like for the purpose of adjusting the specific gravity.

The mid layer 10 has a hardness Hm of equal to or less than 55. This mid layer 10 is soft. This mid layer 10 is responsible for the feel at impact of the golf ball 2. According to the golf ball 2 having this mid layer 10, a deformation behavior upon impact with a driver is optimized. Owing to the optimal deformation behavior, initial spin rate is suppressed, thereby elevating the flight distance. In light of the feel at impact and flight performance, the hardness Hm is more preferably equal to or less than 50, and particularly preferably equal to or less than 45. In light of the resilience performance of the golf ball 2, the hardness Hm is preferably equal to or greater than 25, more preferably equal to or greater than 30, and particularly preferably equal to or greater than 35.

The hardness Hm of the mid layer 10 is equal to or less than the surface hardness Hs of the center 8. According to this golf ball 2, appropriate deformation behavior upon impact can be attained. Difference in hardness (Hs−Hm) is preferably equal to or greater than 5, and more preferably equal to or greater than 10. The difference in hardness (Hs−Hm) is preferably equal to or less than 25.

The mid layer 10 has a thickness Tm of equal to or less than 1.6 mm. In other words, this mid layer is thin. Thin mid layer 10 does not inhibit the resilience performance of the golf ball 2. In light of the resilience performance, the thickness Tm is more preferably equal to or less than 1.4 mm. In light of the feel at impact and suppression of spin, the thickness Tm is preferably equal to or greater than 0.3 mm, and particularly preferably equal to or greater than 0.5 mm.

Examples of base polymer suitable for the cover 6 include ionomer resins, styrene block-containing thermoplastic elastomers, thermoplastic polyurethane elastomers, thermoplastic polyamide elastomers, thermoplastic polyester elastomers and thermoplastic polyolefin elastomers. In light of the resilience performance of the golf ball 2, ionomer resins are preferred. When other polymer is used in combination with the ionomer resin, amount of the ionomer resin to be blended is preferably equal to or greater than 50 parts by weight per 100 parts of the entire base polymer.

The ionomer resin suited for the cover 6 is an ethylene-(meth)acrylic acid copolymer-based ionomer resin. An ethylene-(meth)acrylic acid copolymer-based ionomer resin having a material hardness of 50 or greater and 70 or less is particularly preferred. Amount of the ethylene-(meth)acrylic acid copolymer-based ionomer resin having a material hardness of 50 or greater and 70 or less to be blended is preferably equal to or greater than 50 parts by weight, and particularly preferably equal to or greater than 70 parts by weight per 100 parts by weight of the entire base polymer.

Into the cover 6 may be blended a coloring agent such as titanium dioxide, a filler such as barium sulfate, a dispersant, an antioxidant, an ultraviolet absorbent, a light stabilizer, a fluorescent agent, a fluorescent brightening agent and the like in an appropriate amount as needed.

The cover 6 has a hardness Hc of equal to or greater than 50. This cover 6 is hard. This cover 6 is responsible for the resilience performance of the golf ball 2. In light of the resilience performance, the hardness Hc is more preferably equal to or greater than 55. In light of the feel at impact of the golf ball 2, the hardness Hc is preferably equal to or less than 65.

The cover 6 has a thickness Tc of equal to or less than 1.6 mm. Although the cover 6 is hard as described above, setting the thickness Tc to be equal to or less than 1.6 mm may suppress adverse influence of the cover 6 on the feel at impact. By setting the thickness Tc of the cover 6 to be equal to or less than 1.6 mm, appropriate deformation behavior can be attained, and the spin may be suppressed. In light of the feel at impact and suppression of spin, the thickness Tc is more preferably equal to or less than 1.4 mm. In light of the resilience performance and durability performance of the golf ball 2, the thickness Tc is preferably equal to or greater than 0.5 mm, and more preferably equal to or greater than 0.8 mm.

In light of achievement of both the flight performance and the feel at impact, it is preferred that the hardness Hc of the cover 6 be greater than the hardness Hm of the mid layer 10. The difference (Hc−Hm) therebetween is preferably equal to or greater than 8, and more preferably equal to or greater than 13. The difference (Hc−Hm) is preferably equal to or less than 30.

In light of the resilience performance of the golf ball 2, ratio (Tc/Tm) of the thickness Tc of the cover 6 to the thickness Tm of the mid layer 10 is preferably equal to or greater than 1.0, and more preferably equal to or greater than 1.2. In light of the feel at impact and suppression of spin of the golf ball 2, the ratio (Tc/Tm) is preferably equal to or less than 2.0, more preferably equal to or less than 1.8, and particularly preferably equal to or less than 1.6.

Figure 2:
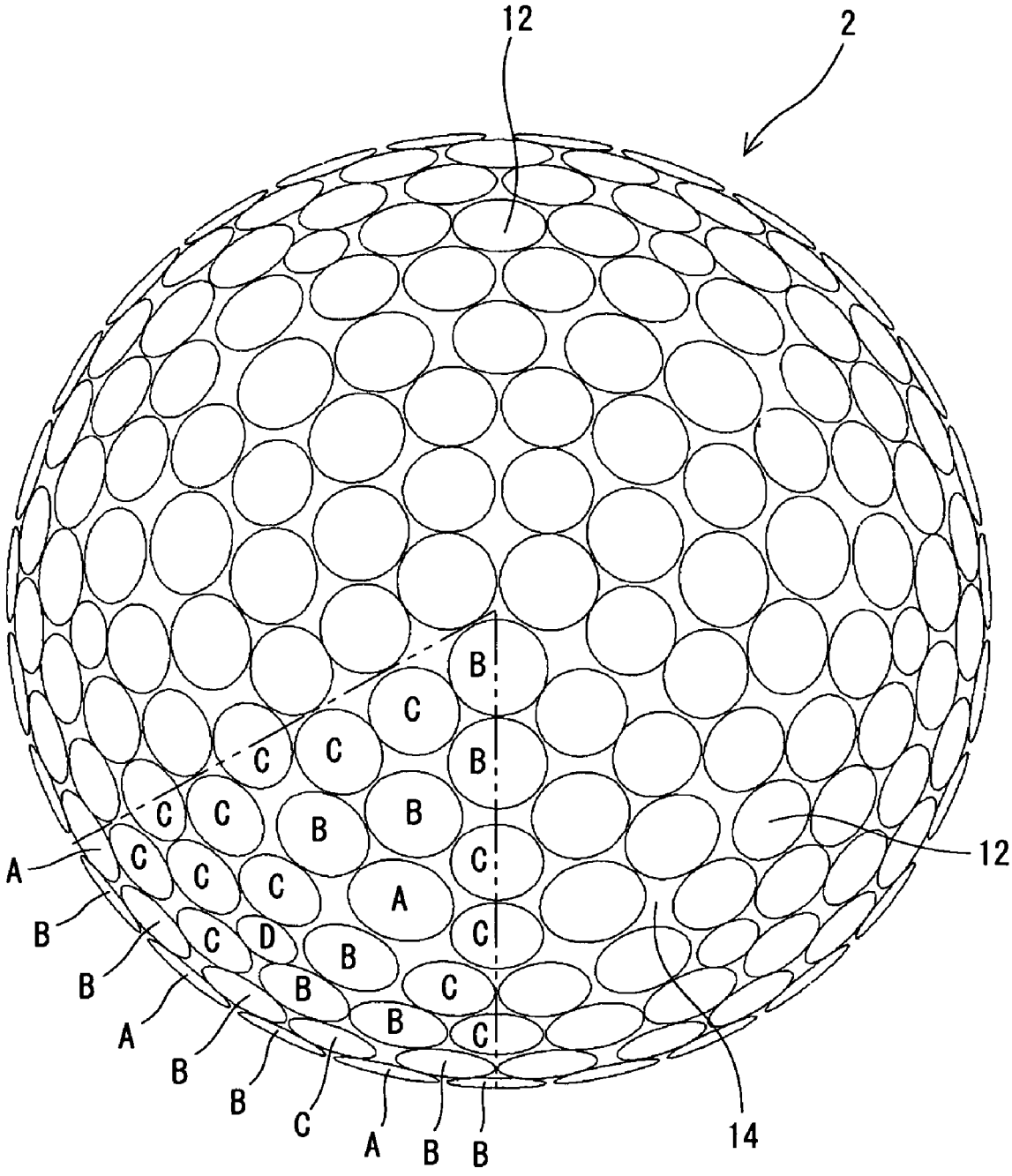
FIG. 2 is an enlarged plan view illustrating the golf ball shown in FIG. 1.
Figure 3:
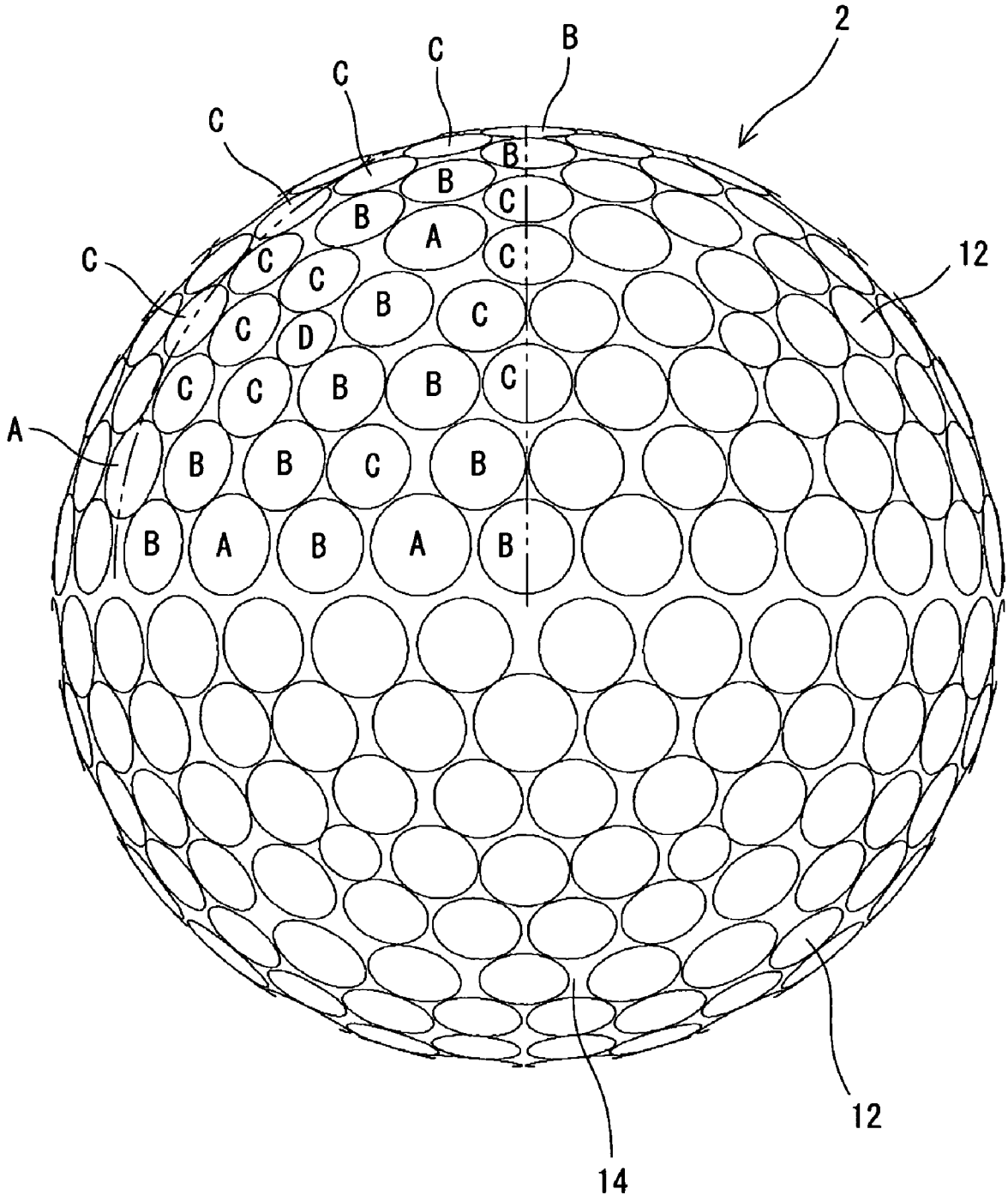
FIG. 3 is a front view illustrating the golf ball shown in FIG. 2.

FIG. 2 is an enlarged plan view illustrating the golf ball 2 shown in FIG. 1; and FIG. 3 is a front view of the same. As is clear from FIG. 2 and FIG. 3, the plane shape of all the dimples 12 is circular. In FIG. 2 and FIG. 3, kinds of the dimples 12 are denoted by symbols A to D in one unit, provided when the surface of the golf ball 2 is comparted into twelve equivalent units. This golf ball 2 has dimples A having a diameter of 4.65 mm, dimples B having a diameter of 4.30 mm, dimples C having a diameter of 4.00 mm, and dimples D having a diameter of 3.00 mm. The number of the dimples A is 42; the number of the dimples B is 138; the number of the dimples C is 138; and the number of the dimples D is 12. Total number of the dimples 12 of this golf ball 2 is 330.

Figure 4:
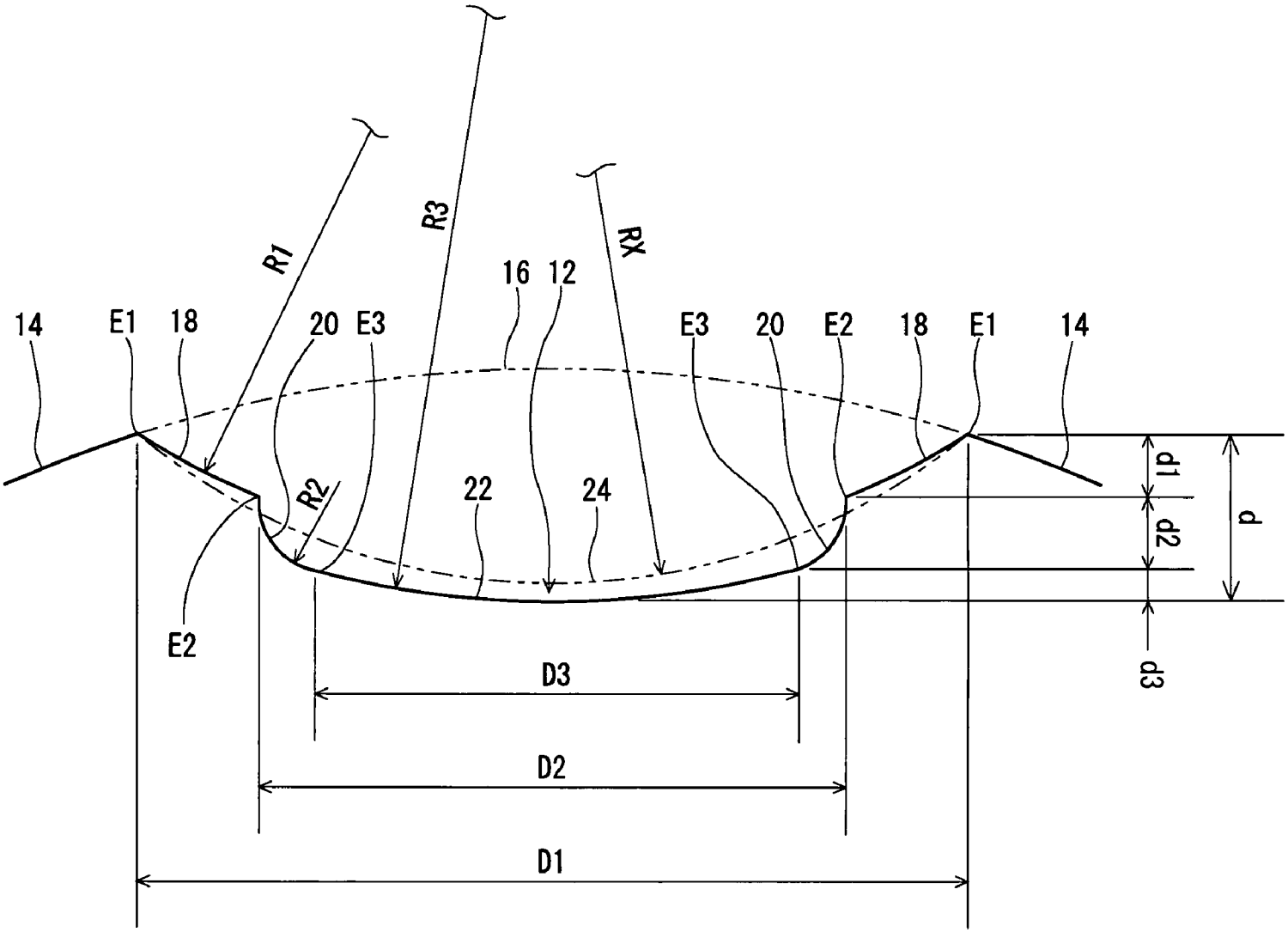
FIG. 4 is an enlarged cross-sectional view illustrating a part of the golf ball shown in FIG. 1.

FIG. 4 is an enlarged cross-sectional view illustrating a part of the golf ball 2 shown in FIG. 1. In this FIG. 4, a cross section along a plane passing through the weighted center of area of the dimple 12 and the center of the golf ball 2 is shown. A top-to-bottom direction in FIG. 4 is an in-depth direction of the dimple 12. The in-depth direction is a direction from the weighted center of area of the dimple 12 toward the center of the golf ball 2. What is indicated by a chain double-dashed line 16 in FIG. 4 is a phantom sphere. The surface of the phantom sphere 16 corresponds to a surface of the golf ball 2 when it is postulated that there is no dimple 12 present. The dimple 12 is recessed from the phantom sphere 16. The land 14 agrees with the phantom sphere 16.

This dimple 12 has a first side wall face 18, a second side wall face 20 and a bottom face 22. The first side wall face 18 and the second side wall face 20 are ring shaped. The bottom face 22 is bowl shaped. The first side wall face 18 is continued to the land 14 at a point E1. The point E1 corresponds to the edge of the dimple 12. The edge E1 defines plane shape of the dimple 12. The second side wall face 20 is positioned on the bottom side of the first side wall face 18. The second side wall face 20 is continued to the first side wall face 18 at the point E2. The bottom face 22 is positioned on the bottom side of the second side wall face 20. The bottom face 22 is continued to the second side wall face 20 at the point E3.

What is indicated by a both-oriented arrowhead D1 in FIG. 4 is the diameter of the dimple 12. This diameter D1 is also a maximum diameter of the first side wall face 18. What is indicated by a both-oriented arrowhead D2 is a maximum diameter of the second side wall face 20. What is indicated by a both-oriented arrowhead D3 is a maximum diameter of the bottom face 22.

What is indicated by a chain double-dashed line 24 in FIG. 4 is a phantom dimple 24. The phantom dimple 24 has a cross-sectional shape of a circular arc. Curvature radius of this circular arc is denoted by a reference sign Rx in FIG. 4. This phantom dimple 24 is a single radius dimple. The phantom dimple 24 has a diameter of D1. In other words, the phantom dimple 24 has a diameter that is equal to the diameter of the dimple 12. The phantom dimple 24 is envisioned to have a volume that is equal to the volume of the dimple 12. The phantom curvature radius Rx is usually 5.0 mm or greater and 25.0 mm or less.

The first side wall face 18 is convex downward. The first side wall face 18 has a curvature radius R1 that is equal to or greater than the phantom curvature radius Rx. In other words, the first side wall face 18 curves gently. The air passed through the land 14 flows along the first side wall face 18. The air flows smoothly from the land 14 toward the center of the dimple 12 because the first side wall face 18 has a gentle curve. In light of the smooth flow, the curvature radius R1 is preferably equal to or greater than 7.0 mm, and particularly preferably equal to or greater than 8.0 mm. The curvature radius R1 is preferably equal to or less than 30.0 mm.

Maximum diameter line of the first side wall face 18 passes through the point E1. In other words, the first side wall face 18 does not run off the point E1 outside in the horizontal direction. Accordingly, accumulation of the air is prevented. The undermost point of the first side wall face 18 agrees with the point E2. In other words, the first side wall face 18 inclines downward from the point E1 to the point E2. Accordingly, accumulation of the air is prevented.

The second side wall face 20 is convex downward. The second side wall face 20 has a curvature radius R2 that is less than the phantom curvature radius Rx. The air passed through the first side wall face 18 flows along the second side wall face 20. Direction of the air is suddenly changed by the second side wall face 20. This change in direction enhances the dimple effect. In light of the dimple effect, the curvature radius R2 is preferably equal to or less than 0.40 time, more preferably equal to or less than 0.30 time, and particularly preferably equal to or less than 0.25 time greater than the phantom curvature radius Rx. The curvature radius R2 is preferably equal to or more than 0.10 time greater than the phantom curvature radius Rx. The curvature radius R2 is preferably 1.5 mm or greater and 5.0 mm or less.

Maximum diameter line of the second side wall face 20 passes through the point E2. In other words, the second side wall face 20 does not run off the point E2 outside in the horizontal direction. Accordingly, accumulation of the air is prevented. The undermost point of the second side wall face 20 agrees with the point E3. In other words, the second side wall face 20 inclines downward from the point E2 to the point E3. Accordingly, accumulation of the air is prevented.

The bottom face 22 is convex downward. The bottom face 22 has a curvature radius R3 that is equal to or greater than the phantom curvature radius Rx. In other words, the bottom face 22 curves gently. The air passed through the second side wall face 20 flows along the bottom face 22. The air is smoothly introduced to the opposite second side wall face 20 by means of this bottom face 22. Direction of the air is suddenly changed by the opposite second side wall face 20. This change in direction enhances the dimple effect. In light of smooth air flow, the curvature radius R3 of the bottom face 22 is preferably equal to or more than 1.10 times, and more preferably equal to or more than 1.20 times greater than the phantom curvature radius Rx. The curvature radius R3 of the bottom face 22 is preferably equal to or less than 1.70 times greater than the phantom curvature radius Rx. The curvature radius R3 is preferably equal to or greater than 7.0 mm, and particularly preferably equal to or greater than 8.0 mm. The curvature radius R3 is preferably equal to or less than 35.0 mm.

Maximum diameter line of the bottom face 22 passes through the point E3. In other words, the bottom face 22 does not run off the point E3 outside in the horizontal direction. Accordingly, accumulation of the air is prevented.

Ratio (D2/D1) of the maximum diameter D2 of the second side wall face 20 to the diameter D1 of the dimple 12 is preferably 0.60 or greater and 0.95 or less. By setting the ratio (D2/D1) to be equal to or greater than 0.60, the second side wall face 20 and the bottom face 22 sufficiently contribute to the dimple effect. In this respect, the ratio (D2/D1) is more preferably equal to or greater than 0.70, and particularly preferably equal to or grater than 0.75. By setting the ratio (D2/D1) to be equal to or less than 0.95, the first side wall face 18 sufficiently contributes to the dimple effect. In this respect, the ratio (D2/D1) is more preferably equal to or less than 0.93, and particularly preferably equal to or less than 0.90.

Ratio (D3/D2) of the maximum diameter D3 of the bottom face 22 to the diameter D2 is preferably 0.60 or greater and 0.95 or less. By setting the ratio (D3/D2) to be equal to or greater than 0.60, the bottom face 22 sufficiently contributes to the dimple effect. In this respect, the ratio (D3/D2) is more preferably equal to or greater than 0.70, and particularly preferably equal to or grater than 0.75. By setting the ratio (D3/D2) to be equal to or less than 0.95, the second side wall face 20 sufficiently contributes to the dimple effect. In this respect, the ratio (D3/D2) is more preferably equal to or less than 0.93, and particularly preferably equal to or less than 0.90.

What is indicated by a both-oriented arrowhead d1 in FIG. 4 is the depth of the first side wall face 18; what is indicated by a both-oriented arrowhead d2 is the depth of the second side wall face 20; and what is indicated by a both-oriented arrowhead d3 is the depth of the bottom face 22. Sum total of the depth d1, the depth d2 and the depth d3 is the depth d of the dimple 12.

Ratio (d1/d) of the depth d1 of the first side wall face 18 to the depth d of the dimple 12 is preferably 0.10 or greater and 0.50 or less. By setting the ratio (d1/d) to be equal to or greater than 0.10, the first side wall face 18 sufficiently contributes to the dimple effect. In this respect, the ratio (d1/d) is more preferably equal to or greater than 0.15, and particularly preferably equal to or greater than 0.20. By setting the ratio (d1/d) to be equal to or less than 0.50, the second side wall face 20 or the bottom face 22 sufficiently contributes to the dimple effect. In this respect, the ratio (d1/d) is more preferably equal to or less than 0.45, and particularly preferably equal to or less than 0.40.

Ratio (d2/d) of the depth d2 of the second side wall face 20 to the depth d of the dimple 12 is preferably 0.10 or greater and 0.60 or less. By setting the ratio (d2/d) to be equal to or greater than 0.10, the second side wall face 20 sufficiently contributes to the dimple effect. In this respect, the ratio (d2/d) is more preferably equal to or greater than 0.15, and particularly preferably equal to or greater than 0.20. By setting the ratio (d2/d) to be equal to or less than 0.60, the first side wall face 18 or the bottom face 22 sufficiently contributes to the dimple effect. In this respect, the ratio (d2/d) is more preferably equal to or less than 0.55, and particularly preferably equal to or less than 0.50.

Ratio (d3/d) of the depth d3 of the bottom face 22 to the depth d of the dimple 12 is preferably 0.05 or greater and 0.50 or less. By setting the ratio (d3/d) to be equal to or greater than 0.05, the bottom face 22 sufficiently contributes to the dimple effect. In this respect, the ratio (d3/d) is more preferably equal to or greater than 0.10, and particularly preferably equal to or greater than 0.15. By setting the ratio (d3/d) to be equal to or less than 0.50, the first side wall face 18 or the second side wall face 20 sufficiently contributes to the dimple effect. In this respect, the ratio (d3/d) is more preferably equal to or less than 0.45, and particularly preferably equal to or less than 0.40.

In light of achievement of a sufficient dimple effect, the diameter D1 of the dimple 12 is preferably equal to or greater than 2.0 mm, more preferably equal to or greater than 2.2 mm, and particularly preferably equal to or greater than 2.4 mm. In light of avoidance of impairment of a feature of the golf ball 2 which is substantially a sphere, the diameter D1 is preferably equal to or less than 6.0 mm, more preferably equal to or less than 5.8 mm, and particularly preferably equal to or less than 5.6 mm.

Area s of the dimple 12 is an area of a region surrounded by the contour line when the center of the golf ball 2 is viewed at infinity. In instances of a circular dimple 12, the area s is calculated by the following formula:

$$s=(D1/2)^{2*}\pi.$$

In the golf ball 2 shown in FIG. 2 and FIG. 3, the area of the dimple A is 16.98 $mm^2$; the area of the dimple B is 14.52 $mm^2$; the area of the dimple C is 12.57 $mm^2$; and the area of the dimple D is 7.07 $mm^2$.

According to the present invention, ratio of sum of areas of all the dimples 12 to the surface area of the phantom sphere 16 is referred to as an occupation ratio. From the standpoint that a sufficient dimple effect may be achieved, the occupation ratio is preferably equal to or greater than 70%, more preferably equal to or greater than 72%, and particularly preferably equal to or greater than 74%. The occupation ratio is preferably equal to or less than 90%. According to the golf ball 2 shown in FIG. 2 and FIG. 3, total area of the dimples 12 is 4536.3 $mm^2$. Because the surface area of the phantom sphere 16 of this golf ball 2 is 5728.0 $mm^2$, the occupation ratio is 79.2%.

In light of possible suppression of hopping of the golf ball 2, the dimple 12 has a depth d of preferably equal to or greater than 0.05 mm, more preferably equal to or greater than 0.08 mm, and particularly preferably equal to or greater than 0.10 mm. In light of possible suppression of dropping of the golf ball 2, the depth d is preferably equal to or less than 0.60 mm, more preferably equal to or less than 0.45 mm, and particularly preferably equal to or less than 0.40 mm.

According to the present invention, the term "dimple volume" means a volume of a part surrounded by a plane including the contour of the dimple 12, and the surface of the dimple 12. In light of possible suppression of hopping of the golf ball 2, the dimples 12 have a total volume of preferably equal to or greater than 250 $mm^3$, more preferably equal to or greater than 260 $mm^3$, and particularly preferably equal to or greater than 270 $mm^3$. In light of possible suppression of dropping of the golf ball 2, the total volume is preferably equal to or less than 400 $mm^3$, more preferably equal to or less than 390 $mm^3$, and particularly preferably equal to or less than 380 $mm^3$.

In light of achievement of a sufficient dimple effect, total number of the dimples 12 is preferably equal to or greater than 200, more preferably equal to or greater than 240, and particularly preferably equal to or greater than 260. In light of possible securing of a sufficient diameter of respective dimples, the total number is preferably equal to or less than 500, more preferably equal to or less than 480, and particularly preferably equal to or less than 460.

The dimple 12 illustrated in FIG. 4 meets requirements of from (a) to (c):

(a) a first side wall face 18 being provided which has a curvature radius R1 that is equal to or greater than the phantom curvature radius Rx;

(b) a second side wall face 20 being provided which is positioned to the bottom side than the first side wall face 18 and has a curvature radius R2 that is smaller than the phantom curvature radius Rx; and (c) a bottom face 22 being provided which is positioned to the bottom side than the second side wall face 20 and has a curvature radius R3 that is equal to or greater than the phantom curvature radius Rx. Proportion of the number of the dimples 12 that meet the requirements of from (a) to (c) in total number of the dimples 12 is preferably equal to or greater than 40%, more preferably equal to or greater than 50%, and particularly preferably equal to or greater than 60%. This proportion is ideally 100%.

According to this golf ball 2, the hard cover 6 is responsible for the resilience performance, while the dimples 12 are responsible for the aerodynamic characteristic. According to this golf ball 2, a great flight distance can be attained owing to a synergistic effect of the excellent resilience performance and the excellent aerodynamic characteristic. According to this golf ball 2, the cover 6 is so thin that a soft feel at impact may be experienced despite of the cover 6 being hard. When the core 4 has the center 8 and the soft mid layer 10, the feel at impact may be further improved.

EXAMPLES

Example 1

A rubber composition was obtained by kneading 100 parts by weight of polybutadiene (trade name "BR-730", available from JSR Corporation), 22 parts by weight of zinc acrylate, 5 parts of zinc oxide, an adequate amount of barium sulfate, 0.3 part by weight of bis(pentabromophenyl)disulfide and 0.6 part by weight of dicumyl peroxide. This rubber composition was placed into a mold having upper and lower mold half each having a hemispherical cavity, and heated at 170° C. for 30 minutes to obtain a center having a diameter of 37.5 mm. On the other hand, a type d resin composition shown in Table 2 below was prepared. The aforementioned center was placed into a mold, and the resin composition was injected around the center by injection molding to form a mid layer having a thickness of 1.2 mm. Further, a type h resin composition shown in Table 3 below was prepared. The aforementioned core comprising the center and the mid layer was placed into a mold having numerous protrusions on the inside face, followed by injection of the resin composition around the spherical body by injection molding to form a cover having a thickness of 1.4 mm. Numerous dimples having a shape inverted from the shape of the protrusion were formed on the cover. Paint was applied on this cover to give a golf ball of Example 1 having a diameter of 42.7 mm and a weight of about 45.4 g. This golf ball had a total volume of the dimples of about 320 $mm^3$. This golf ball has a dimple pattern of type I shown in Table 4 below.

Examples 2 to 4 and Comparative Examples 1 to 5

Figure 5:
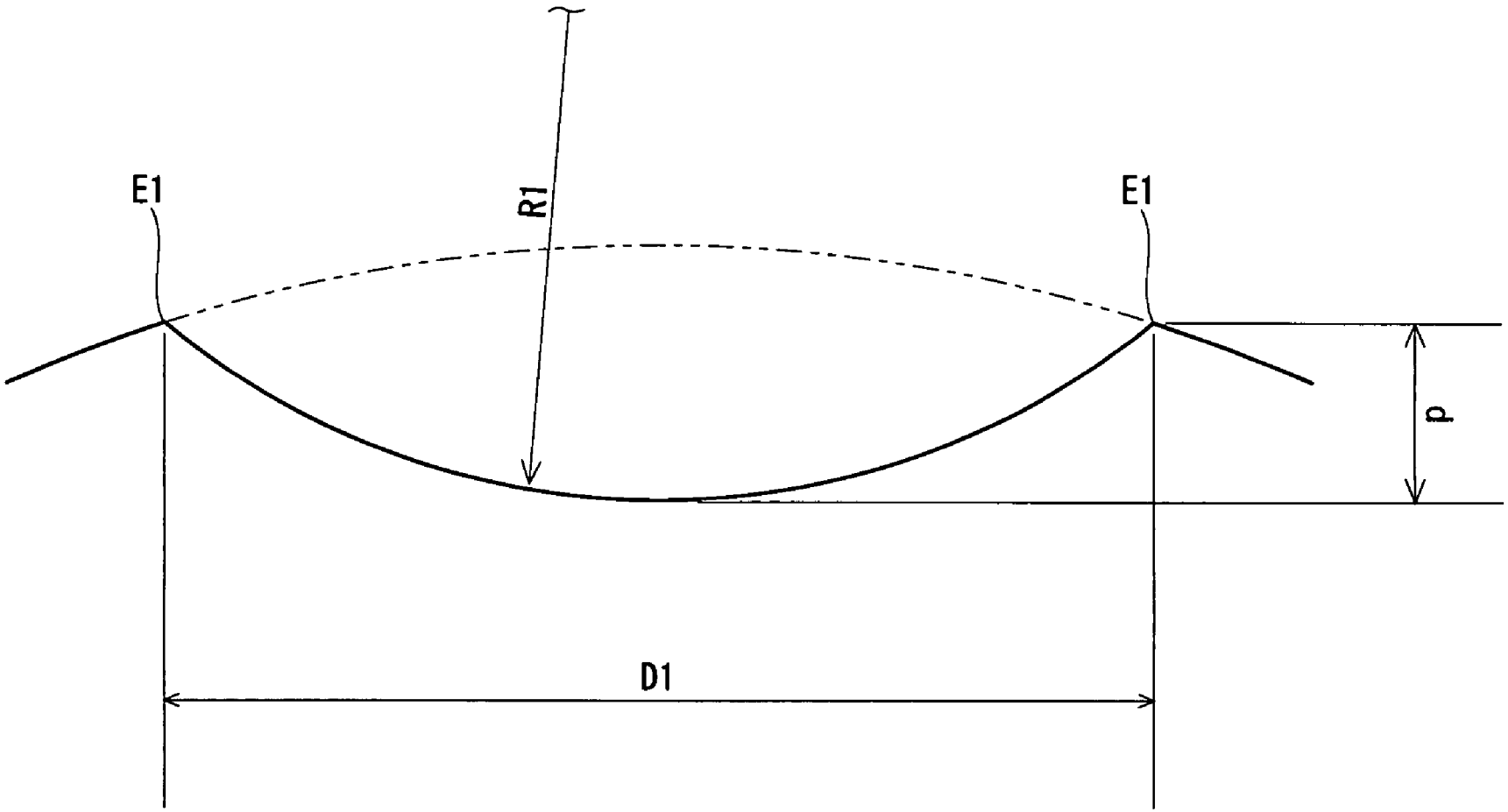
FIG. 5 is an enlarged cross-sectional view illustrating a part of the golf ball according to Comparative Example 3.
Figure 6:
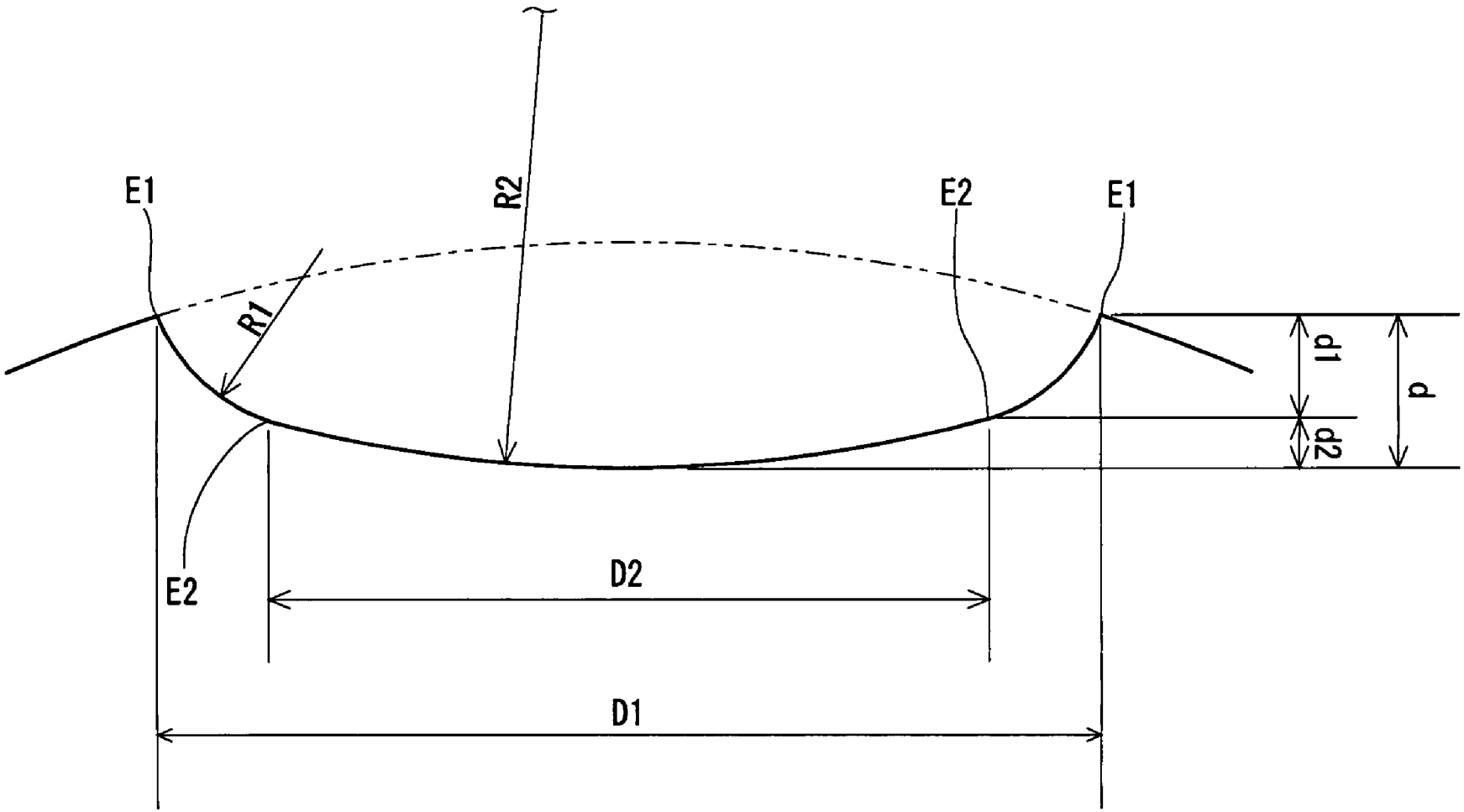
FIG. 6 is an enlarged cross-sectional view illustrating a part of the golf ball according to Comparative Example 4.

In a similar manner to Example 1 except that specifications of the center, the mid layer, the cover and the dimples were as listed in Table 6 and Table 7 below, golf balls of Examples 2 to 4 and Comparative Examples 1 to 5 were obtained. Details of the rubber composition of the center are listed in Table 1 below; details of the resin composition of the mid layer are listed in Table 2 below; details of the resin composition of the cover are listed in Table 3 below; and details of specifications of the dimples are listed in Table 4 and Table 5 below. Cross-sectional shape of the dimple of Comparative Example 3 is illustrated in FIG. 5. The cross-sectional shape of this dimple includes a circular arc having a curvature radius of R1. Cross-sectional shape of the dimple of Comparative Example 4 is illustrated in FIG. 6. The cross-sectional shape of this dimple includes a circular arc having a curvature radius of R1, and a circular arc having a curvature radius of R2.

TABLE 1

Rubber composition of center (part by weight)

| Type | a | b |
|---|---|---|
| Polybutadiene | 100 | 100 |
| Zinc acrylate | 24 | 22 |
| Zinc oxide | 5 | 5 |
| Barium sulfate | adequate amount | adequate amount |
| Bis(pentabromophenyl)disulfide | 0.3 | 0.3 |
| Dicumyl peroxide | 0.6 | 0.6 |
| Surface hardness (Shore D) | 52 | 48 |

TABLE 2

| Resin composition of mid layer (part by weight) | | | | |
|---|---|---|---|---|
| Type | c | d | e | f |
| Surlyn 8945 (material hardness: 61) | 35 | 25 | 50 | — |
| Surlyn 9945 (material hardness: 60) | 30 | 20 | 40 | — |
| Elastollan ET880 (material hardness: 30) | — | — | — | 100 |
| Rabalon T3339C (material hardness: 7) | 35 | 55 | 10 | — |
| Proportion Pst (%) | 35 | 55 | 10 | 0 |
| Proportion Pio (%) | 65 | 45 | 90 | 0 |
| Hardness (Shore D) | 46 | 35 | 58 | 30 |

TABLE 3

| Resin composition of cover (part by weight) | | | |
|---|---|---|---|
| Type | g | h | i |
| Himilan 1555 (material hardness: 57) | 60 | — | 40 |
| Himilan 1557 (material hardness: 57) | 40 | — | 30 |
| Himilan 1605 (material hardness: 62) | — | 40 | — |
| Himilan 1706 (material hardness: 61) | — | 35 | — |
| Rabalon T3339C (material hardness: 7) | — | 25 | 30 |
| Titanium dioxide | 2 | 2 | 2 |
| Barium sulfate | 2 | 2 | 2 |
| Hardness (Shore D) | 59 | 54 | 48 |

[Measurement of Resilience Coefficient]

To the golf ball was impacted a hollow cylinder made of aluminum the weight of which being 200 g at a velocity of 40 m/s. Then, velocity of the hollow cylinder prior to and after the impact, and the velocity of the golf ball after the impact were measured to determine the resilience coefficient of the golf ball. Mean values obtained by 12 times measurement are shown in Table 6 and Table 7 below as indices on the basis of the resilience coefficient of the golf ball of Comparative Example 1 being presumed as 1.00.

[Travel Distance Test]

A driver with a metal head (trade name "XXIO", available from Sumitomo Rubber Industries, Ltd., shaft hardness: R, loft angle: 11°) was attached to a swing machine, available from True Temper Co. Then the golf ball was hit under the condition to provide a head speed of 40 m/sec. Accordingly, the distance from the launching point to the point where the ball stopped was measured. Mean values of 12 times measurement are shown in Table 6 and Table 7 below.

[Evaluation of Feel at Impact]

Using a driver, the golf balls were hit by 10 golf players. Those which were evaluated as favorable in the feel at impact by 8 or more golf players were assigned "A"; those which were evaluated as favorable by from 6 to 7 golf players were assigned "B", those which were evaluated as favorable by from 4 to 5 golf players were assigned "C", and those which were evaluated as favorable by 3 or less golf players were assigned "D". The results are presented in Table 6 and Table 7 below.

TABLE 4

| Specifications of dimples | | | | | | | | | | | | | | | |
|---|---|---|---|---|---|---|---|---|---|---|---|---|---|---|---|
| | | | Diameter (mm) | | | Depth (mm) | | | | Curvature radius (mm) | | | | Volume | Cross sectional |
| Type | Kind | Number | D1 | D2 | D3 | d1 | d2 | d3 | d | R1 | R2 | R3 | Rx | ($mm^3$) | view |
| I | A | 42 | 4.650 | 3.938 | 3.150 | 0.040 | 0.043 | 0.047 | 0.130 | 19.2 | 3.0 | 25.4 | 19.2 | 1.199 | Fig. 4 |
| | B | 138 | 4.300 | 3.642 | 2.914 | 0.040 | 0.042 | 0.048 | 0.130 | 16.5 | 3.0 | 21.8 | 16.5 | 1.025 | |
| | C | 138 | 4.000 | 3.388 | 2.710 | 0.040 | 0.042 | 0.048 | 0.130 | 14.3 | 3.0 | 19.1 | 14.3 | 0.887 | |
| | D | 12 | 3.000 | 2.542 | 2.034 | 0.040 | 0.041 | 0.049 | 0.130 | 8.0 | 3.0 | 11.3 | 8.0 | 0.500 | |
| II | A | 42 | 4.650 | 4.309 | 3.447 | 0.020 | 0.054 | 0.046 | 0.120 | 19.2 | 3.0 | 32.3 | 19.2 | 1.199 | Fig. 4 |
| | B | 138 | 4.300 | 3.985 | 3.108 | 0.020 | 0.057 | 0.043 | 0.120 | 16.5 | 3.0 | 28.0 | 16.5 | 1.025 | |
| | C | 138 | 4.000 | 3.707 | 2.080 | 0.020 | 0.061 | 0.039 | 0.120 | 14.3 | 3.0 | 24.7 | 14.3 | 0.887 | |
| | D | 12 | 3.000 | 2.781 | 1.808 | 0.020 | 0.073 | 0.027 | 0.120 | 8.0 | 3.0 | 15.8 | 8.0 | 0.500 | |
| III | A | 42 | 4.650 | 3.891 | — | 0.054 | 0.066 | — | 0.120 | 3.0 | 29.0 | — | 19.2 | 1.199 | Fig. 6 |
| | B | 138 | 4.300 | 3.457 | — | 0.060 | 0.060 | — | 0.120 | 3.0 | 25.2 | — | 16.5 | 1.025 | |
| | C | 138 | 4.000 | 3.068 | — | 0.067 | 0.053 | — | 0.120 | 3.0 | 22.1 | — | 14.3 | 0.887 | |
| | D | 12 | 3.000 | 1.979 | — | 0.084 | 0.036 | — | 0.120 | 3.0 | 13.6 | — | 8.0 | 0.500 | |

TABLE 5

| Specifications of dimples | | | | | | | | | | | | | | | |
|---|---|---|---|---|---|---|---|---|---|---|---|---|---|---|---|
| | | | Diameter (mm) | | | Depth (mm) | | | | Curvature radius (mm) | | | | Volume | Cross sectional |
| Type | Kind | Number | D1 | D2 | D3 | d1 | d2 | d3 | d | R1 | R2 | R3 | Rx | ($mm^3$) | view |
| IV | A | 42 | 4.650 | — | — | — | — | — | 0.141 | 19.2 | — | — | 19.2 | 1.199 | Fig. 5 |
| | B | 138 | 4.300 | — | — | — | — | — | 0.141 | 16.5 | — | — | 16.5 | 1.025 | |
| | C | 138 | 4.000 | — | — | — | — | — | 0.141 | 14.3 | — | — | 14.3 | 0.887 | |
| | D | 12 | 3.000 | — | — | — | — | — | 0.141 | 8.0 | — | — | 8.0 | 0.500 | |
| V | A | 42 | 4.650 | 4.073 | 3.258 | 0.040 | 0.039 | 0.041 | 0.120 | 15.9 | 3.0 | 31.9 | 19.2 | 1.199 | Fig. 4 |
| | B | 138 | 4.300 | 3.766 | 3.013 | 0.040 | 0.040 | 0.040 | 0.120 | 13.6 | 3.0 | 27.7 | 16.5 | 1.025 | |
| | C | 138 | 4.000 | 3.504 | 2.803 | 0.040 | 0.040 | 0.040 | 0.120 | 11.8 | 3.0 | 23.8 | 14.3 | 0.887 | |
| | D | 12 | 3.000 | 2.630 | 2.104 | 0.040 | 0.038 | 0.042 | 0.120 | 6.7 | 3.0 | 14.0 | 8.0 | 0.500 | |
| VI | A | 42 | 4.650 | 3.720 | 2.976 | 0.040 | 0.047 | 0.063 | 0.150 | 24.4 | 3.0 | 17.3 | 19.2 | 1.199 | Fig. 4 |
| | B | 138 | 4.300 | 3.441 | 2.753 | 0.040 | 0.047 | 0.063 | 0.150 | 20.9 | 3.0 | 14.8 | 16.5 | 1.025 | |
| | C | 138 | 4.000 | 3.201 | 2.561 | 0.040 | 0.047 | 0.063 | 0.150 | 18.1 | 3.0 | 12.9 | 14.3 | 0.887 | |
| | D | 12 | 3.000 | 2.402 | 1.201 | 0.040 | 0.094 | 0.016 | 0.150 | 10.2 | 3.0 | 7.4 | 8.0 | 0.500 | |

TABLE 6

| | Results of evaluation | | | | |
|---|---|---|---|---|---|
| | Example 1 | Example 2 | Example 3 | Example 4 | Compa. Example 1 |
| Center | | | | | |
| Type | b | a | b | b | b |
| Diameter (mm) | 37.5 | 38.3 | 38.3 | 37.1 | 37.5 |
| Amount of compression deformation (mm) | 4.4 | 3.9 | 4.4 | 4.4 | 4.4 |
| Surface hardness Hs (Shore D) | 48 | 52 | 48 | 48 | 48 |
| Mid layer | | | | | |
| Type | d | c | e | f | d |
| Hardness Hm (Shore D) | 35 | 46 | 58 | 30 | 35 |
| Thickness Tm (mm) | 1.2 | 1.0 | 1.0 | 1.4 | 1.2 |
| Proportion Pst (%) | 55 | 35 | 10 | 0 | 55 |
| Proportion Pio (%) | 45 | 65 | 90 | 0 | 45 |
| Cover | | | | | |
| Type | h | g | h | g | i |
| Hardness Hc (Shore D) | 54 | 59 | 54 | 59 | 48 |
| Thickness Tc (mm) | 1.4 | 1.2 | 1.2 | 1.4 | 1.4 |
| Dimple | | | | | |
| Type | I | I | II | I | I |
| Cross-sectional shape | Triple radius | Triple radius | Triple radius | Triple radius | Triple radius |
| R1 | >Rx | >Rx | >Rx | >Rx | >Rx |
| R3 | >Rx | >Rx | >Rx | >Rx | >Rx |
| Hs - Hm | 13 | 6 | −10 | 18 | 13 |
| Tc / Tm | 1.17 | 1.20 | 1.20 | 1.00 | 1.17 |
| Resilience coefficient (index) | 1.01 | 1.03 | 1.02 | 1.01 | 1.00 |
| Travel distance (m) | 194.5 | 196.5 | 195.0 | 194.0 | 193.0 |
| Feel at impact | A | A | B | A | A |

TABLE 7

| | Results of evaluation | | | | |
|---|---|---|---|---|---|
| | Compa. Example 2 | Compa. Example 3 | Compa. Example 4 | Compa. Example 5 | Compa. Example 6 |
| Center | | | | | |
| Type | b | a | b | b | b |
| Diameter (mm) | 36.3 | 38.3 | 37.5 | 37.5 | 37.5 |
| Amount of compression deformation (mm) | 4.4 | 3.9 | 4.4 | 4.4 | 4.4 |
| Surface hardness Hs (Shore D) | 48 | 52 | 48 | 48 | 48 |
| Mid layer | | | | | |
| Type | d | c | d | d | d |
| Hardness Hm (Shore D) | 35 | 46 | 35 | 35 | 35 |
| Thickness Tm (mm) | 1.2 | 1.0 | 1.2 | 1.2 | 1.2 |
| Proportion Pst (%) | 55 | 35 | 55 | 55 | 55 |
| Proportion Pio (%) | 45 | 65 | 45 | 45 | 45 |
| Cover | | | | | |
| Type | h | g | h | h | h |
| Hardness Hc (Shore D) | 54 | 59 | 54 | 54 | 54 |
| Thickness Tc (mm) | 2.0 | 1.2 | 1.4 | 1.4 | 1.4 |
| Dimple | | | | | |
| Type | I | IV | III | V | VI |
| Cross-sectional shape | Triple radius | Single radius | Double radius | Triple radius | Triple radius |
| R1 | >Rx | — | — | <Rx | >Rx |
| R2 | >Rx | — | — | >Rx | <Rx |
| Hs - Hm | 13 | 6 | 13 | 13 | 13 |
| Tc / Tm | 1.67 | 1.20 | 1.17 | 1.17 | 1.17 |

TABLE 7-continued

| | Results of evaluation | | | | |
|---|---|---|---|---|---|
| | Compa. Example 2 | Compa. Example 3 | Compa. Example 4 | Compa. Example 5 | Compa. Example 6 |
| Resilience coefficient (index) | 1.02 | 1.03 | 1.01 | 1.01 | 1.01 |
| Travel distance (m) | 194.5 | 192.5 | 191.5 | 192.5 | 192.5 |
| Feel at impact | C | A | A | A | A |

As shown in Table 6 and Table 7, the golf balls of Examples are excellent in the flight performance and feel at impact. Therefore, advantages of the present invention are clearly suggested by these results of evaluation.

The present invention is applicable to golf balls which may be used in playing on a golf course, as well as golf balls which may be used on a driving range.

The foregoing description is just for illustrative examples, therefore, various modifications can be made in the scope without departing from the principles of the present invention.

What is claimed is:

1. A golf ball comprising a spherical core, a cover covering said core and numerous dimples formed on the surface thereof, said cover having a shore D hardness of equal to or greater than 50, and a thickness of equal to or less than 1.6 mm, said dimple comprising: a first side wall face that has a curvature radius R1 which is equal to or greater than a phantom curvature radius Rx; a second side wall face that is positioned to the bottom side than said first side wall face and has a curvature radius R2 which is smaller than the phantom curvature radius Rx; and a bottom face that is positioned to the bottom side than said second side wall face and has a curvature radius R3 which is equal to or greater than the phantom curvature radius Rx.

2. The golf ball according to claim 1 wherein ratio of depth of the first side wall face to depth of said dimple is 0.10 or greater and 0.50 or less.

3. The golf ball according to claim 1 wherein ratio of maximum diameter of the second side wall face to diameter of said dimple is 0.60 or greater and 0.95 or less.

4. The golf ball according to claim 1 wherein said core has a spherical center and a mid layer covering said center, said mid layer having a Shore D hardness of 25 or greater and 55 or less, and a thickness of equal to or less than 1.6 mm, surface hardness of said center being equal to or greater than Shore D hardness of the mid layer.

5. The golf ball according to claim 4 wherein ratio of the thickness of the cover to the thickness of said mid layer is 1.0 or greater and 2.0 or less.

6. The golf ball according to claim 4 wherein said mid layer comprises

20% by weight or greater and 60% by weight or less of a styrene block-containing thermoplastic elastomer having a material hardness of less than 10, and 40% by weight or greater and 80% by weight or less of an ethylene-(meth)acrylic acid copolymer-based ionomer resin having a material hardness of 50 or greater and 70 or less.

* * * * *